US005839969A

United States Patent [19]

Klouda

[11] Patent Number: 5,839,969

[45] Date of Patent: Nov. 24, 1998

[54] GOLF SWING TRAINING DEVICE

[76] Inventor: Mark A. Klouda, 1214 Wright Ave., Sioux City, Iowa 51109

[21] Appl. No.: 858,641

[22] Filed: May 19, 1997

[51] Int. Cl.[6] ..... A63B 69/36

[52] U.S. Cl. ..... 473/220; 273/DIG. 25

[58] Field of Search ..... 473/220; 273/DIG. 25

[56] References Cited

U.S. PATENT DOCUMENTS

| | | | |
|---|---|---|---|
| 2,704,322 | 3/1955 | Strayline | 362/190 |
| 2,787,470 | 4/1957 | Barrus et al. | 273/186 |
| 3,355,582 | 11/1967 | Swee | 362/190 |
| 3,719,363 | 3/1973 | Harrison | 473/228 |
| 3,820,795 | 6/1974 | Taylor | 273/186 A |
| 4,693,479 | 9/1987 | McGwire | 273/186 A |
| 4,819,942 | 4/1989 | Lee et al. | 273/186 A |
| 5,082,282 | 1/1992 | Hernberg | 273/186 A |
| 5,230,512 | 7/1993 | Tattershall | 273/186.3 |
| 5,692,964 | 12/1997 | Smith et al. | 473/220 |

*Primary Examiner*—George J. Marlo
*Attorney, Agent, or Firm*—Henderson & Sturm

[57] ABSTRACT

A golf swing training device includes an aerodynamically shaped housing which may be attached by a suction cup to the upper surface of a golf club, preferably a wood because of the larger upper surface area. The housing contains a pair of batteries for selectively illuminating a light source, preferably a red LED, protruding from the top of the housing. The illuminated light source creates a visual "track" of light as the as the club is swung and helps the golfer visualize the path of the club head and the swing plane.

4 Claims, 2 Drawing Sheets

GOLF SWING TRAINING DEVICE

BACKGROUND OF THE INVENTION

1. Field of the Invention

This invention relates to training devices for golfers, and more particularly to a lighted device for attachment to the head of a golf club to help the golfer visualize the swing plane through which the golf club head passes.

2. Description of the Related Art

The sport of golf has been inundated with every sort of device imaginable to try to help the ordinary golfer, duffer and hacker attempt to shave a few shots from his game and lower his handicap to a point where he can achieve at least some minimal measure of self respect. As swing plane, along with club face alignment, is perhaps one of the most important considerations in the golf swing, not surprisingly many of these devices are directed to problems in this area.

U.S. Pat. No. 2,787,470 discloses a "Lighting Attachment for Golf Clubs" utilizing a housing, bolted and clamped to the golf club, which contains three light bulbs which are automatically illuminated during the swing by a centrifugal switch. U.S. Pat. No. 3,820,795 discloses a "Golf Swing Training Device" which utilizes a miniature flashlight clipped to the golf club hosel. U.S. Pat. No. 4,819,942 discloses a "Golf Swing Indicator" utilizing a centrifugally activated light contained within a toroidal housing which slides down the shaft and rests over the golf club hosel. U.S. Pat. No. 5,082,282 discloses a "Dual Light Source Golf Swing Trainer" which simulates a golf club and has a first light source contained within the head as well as a second light source contained within the handle of the device. U.S. Pat. No. 5,230,512 discloses a "Golf Training Device" which utilizes a light source which is attached to the club head by ajacket secured by straps of hook and loop fasteners.

While these prior devices no doubt serve the function for which they were designed, most are considerably more complex and expensive than is necessary. Further, most of the devices interfere with the aerodynamics of the golf club and also add significant weight, thereby disturbing the golf swing themselves and interfering with a proper swing analysis.

BRIEF SUMMARY OF THE INVENTION

The golf swing training device of the present invention discloses an aerodynamically shaped housing which may be attached by a suction cup to the upper surface of a golf club, preferably a wood because of the larger upper surface area. The housing contains a pair of batteries for selectively illuminating a light source, preferably a red LED, protruding from the top of the housing. The illuminated light source creates a visual "track" of light as the as the club is swung and helps the golfer visualize the path of the club head and the swing plane.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
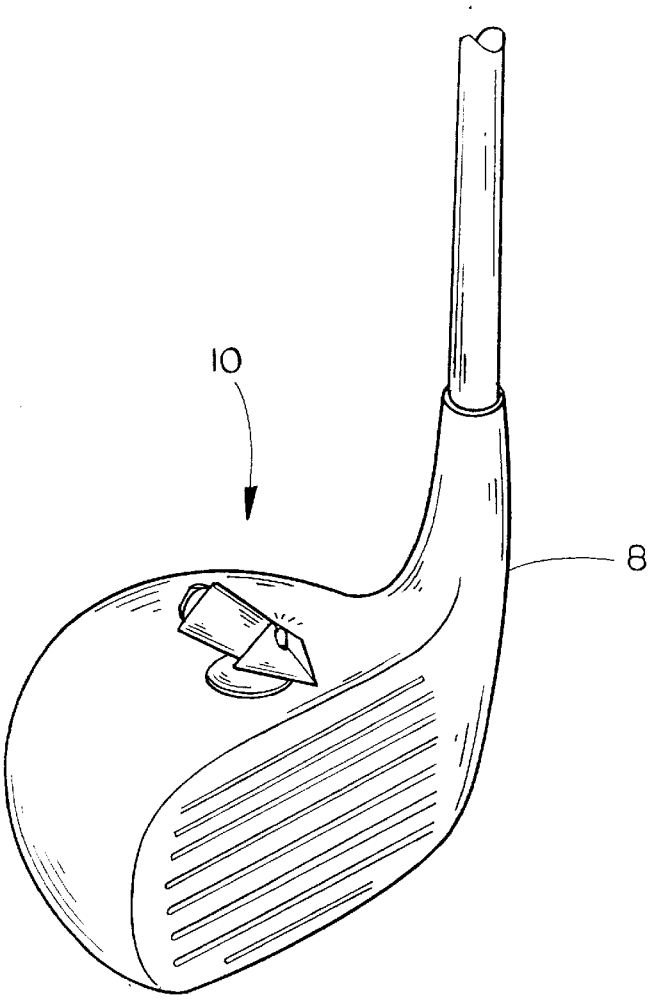
FIG. 1 is a perspective view of the invention secured to the top of a golf club.
Figure 2:
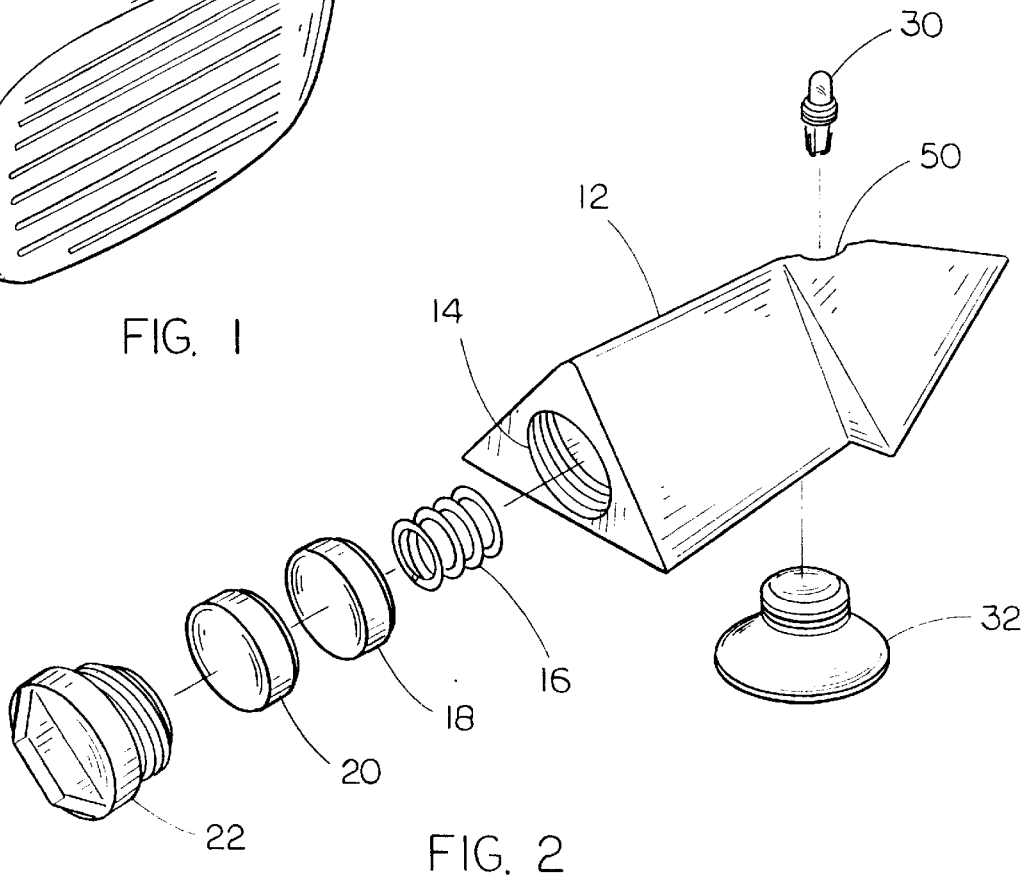
FIG. 2 is an exploded view of the invention.

Referring now to the drawings, wherein like reference numerals designate identical or corresponding parts throughout the several views, FIG. 1 shows the invention depicted generally at 10 and affixed to the upper surface of a golf club 8, in this particular instance a driver. Referring also to the exploded view of FIG. 2, the invention 10 is seen to include an aerodynamically shaped housing 12, preferably fabricated from plastic, although other materials may be appropriate. The housing 12 has a hollow, cylindrical interior with a threaded opening 14 for receipt of a bias spring 16 and a pair of batteries 18, 20. The bias spring 16 and batteries 18, 20 are held in place within the housing 12 by a battery retainer 22 which mates with the threaded opening 14 and also serves to turn the device on and off as will be presently described. The invention 10 is also seen to comprise a light source 30, partially protruding from the upper surface of the housing 12, and a suction cup 32 which may be threaded or glued into an orifice in the lower surface of the housing 12.

The light source 30 of the invention is preferably a red light emitting diode (LED) having a minimum 2000 mcd light output. The batteries 18, 20 are preferably 1.5 volt batteries such as the A-76 available from EVEREADY.

Figure 3A:
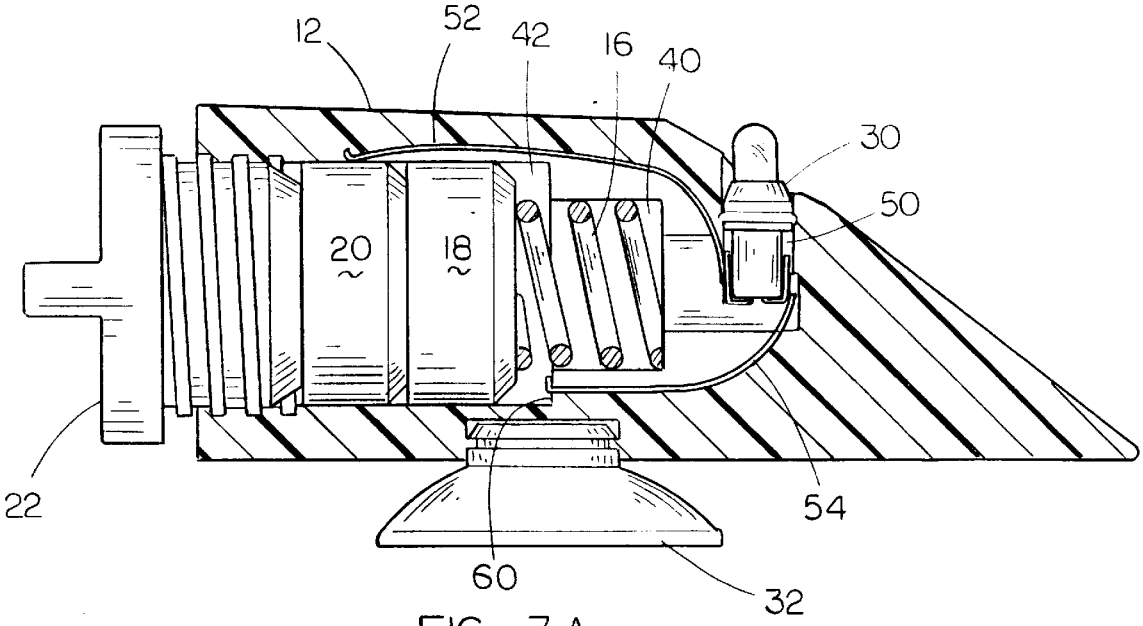
FIG. 3A is a side sectional view of the invention with the light source off.
Figure 3B:
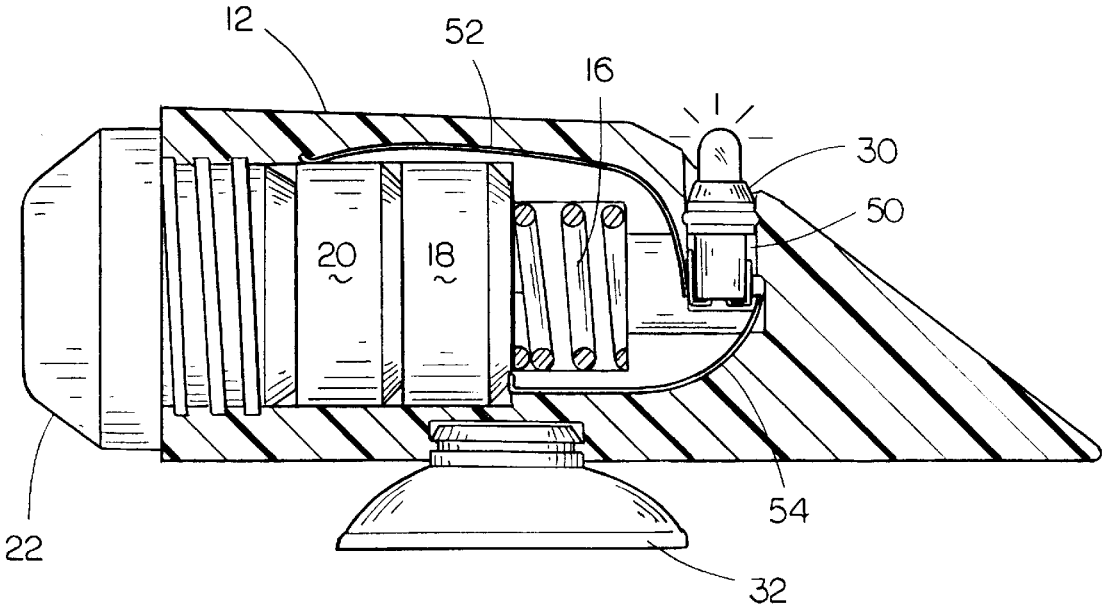
FIG. 3B is a side sectional view of the invention with the light source illuminated.

Referring now to sectional views of FIGS. 3A and 3B, the hollow interior of the housing 12 has a first cylindrical cavity 40 for receipt of the bias spring 16 and a second, contiguous, somewhat larger cylindrical cavity 42 for receipt of the batteries 18, 20. The battery retainer 22 is screwed into the threaded opening 14 of the larger cavity 42 and into non-electrical contact with the batteries 18, 20. The light source 30 is press fit or glued into an upwardly extending socket 50 so as to make electrical contact with a positive lead 52 extending along a peripheral slot in the hollow interior of the housing 12 and into electrical contact with the positive terminal of the second battery 20. The light source 30 also makes electrical contact with a negative electrical lead 54 which extends from the socket 50 along a slot in the housing and to the shoulder 60 of the first cavity 40.

It should therefore be understood that after the various components of the invention are assembled and the battery retainer 22 is installed, as seen in FIG. 3A, the bias spring 16 holds the batteries 18, 20 away from the shoulder 60 and prevents electrical contact between first battery 18 and the negative lead 54. However, electrical contact is present between the second battery 20 and positive lead 52. When the battery retainer 22 is screwed further into the housing 12, the batteries 18, 20 are also driven further into the housing 12 against the action of the bias spring 16, and the first battery 18 makes electrical contact with negative lead 54, causing the light source 30 to illuminate. When the battery retainer 22 is screwed outwardly of the housing 12, the bias spring 16 forces the first battery 18 away from the negative lead 52 and the light source is turned off.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims. For example, it would be obvious to one skilled in the art to modify the invention by adding an electrical switch and therefore a means-plus-function clause is used to describe the battery retainer with the understanding that an electrical switch is its equivalent.

What is claimed is:

1. A golf club including a golf swing training device attached to the upper surface of the head of the club said device comprising:

a housing having a pointed front end and a blunt rear end with an elongate body there between forming a shape that does not add significant weight and does not interfere with the aerodynamics of the golf club, an enlarged cylindrical cavity extending from said blunt end at least partially through said elongate body, a reduced diameter cylindrical cavity axially aligned with said enlarged cylindrical cavity and extending at least partially into said pointed front end, and a vertical slot formed in the pointed front end and intersecting with the reduced diameter cylindrical cavity;

a light source disposed within said vertical slot for projecting a light upwardly from said vertical slot;

a power source disposed within said enlarged cylindrical cavity;

means for selectively placing said power source into electrical contact with said light source; and a suction cup affixed to the bottom of said housing for attaching the training device to the upper surface of the head of a golf club.

2. The training device as in claim 1 wherein said power source comprises at least one battery.

3. The training device as in claim 2 further comprising:

a spring dimensioned to be received in the reduced diameter cavity to bias said at least one battery away from complete electrical contact with said light source.

4. The training device as in claim 3 further comprising:

a battery retainer threadedly engaged in the blunt end of the housing and disposed in moveable engagement with said at least one battery to overcome said spring bias to place said at least one battery in complete electrical contact with said at least one battery.

* * * * *